US007195130B2

(12) United States Patent
Pendergrass et al.

(10) Patent No.: US 7,195,130 B2
(45) Date of Patent: Mar. 27, 2007

(54) DRINKING CUP LIDS WITH PROMOTIONAL GAME PIECE

(75) Inventors: William B. Pendergrass, Hanover, PA (US); Robert J. Schaefer, Baltimore, MD (US); Joseph M. Neukam, Baltimore, MD (US); Peter K. Boller, Toronto (CA)

(73) Assignee: Solo Cup Operating Corporation, Highland Park, IL (US)

( * ) Notice: Subject to any disclaimer, the term of this patent is extended or adjusted under 35 U.S.C. 154(b) by 122 days.

(21) Appl. No.: 10/716,869

(22) Filed: Nov. 20, 2003

(65) Prior Publication Data

US 2005/0109780 A1 May 26, 2005

(51) Int. Cl.
*B65D 51/18* (2006.01)

(52) U.S. Cl. ..... 220/254.1; 220/703

(58) Field of Classification Search ..... 220/254.1, 220/703, 705, 709, 717, 306, 254.3, 257.2, 220/229, 521, 522; 215/387, 388; 206/459.5; 40/307

See application file for complete search history.

(56) References Cited

U.S. PATENT DOCUMENTS

| | | | | |
|---|---|---|---|---|
| 3,459,324 | A | 8/1969 | Miller | |
| 3,514,029 | A | 5/1970 | Powell | |
| 4,032,687 | A | 6/1977 | Hornsby, Jr. | |
| 4,438,865 | A * | 3/1984 | Scattaregia | 220/270 |
| 5,397,023 | A | 3/1995 | Toczek et al. | |
| 5,398,843 | A * | 3/1995 | Warden et al. | 220/711 |
| 5,592,766 | A | 1/1997 | Mygatt | |
| 5,746,312 | A * | 5/1998 | Johnson | 206/217 |
| 5,769,263 | A * | 6/1998 | Willingham et al. | 220/522 |
| 5,971,195 | A | 10/1999 | Reidinger et al. | |
| 6,056,144 | A * | 5/2000 | Strange et al. | 220/297 |
| 6,070,752 | A | 6/2000 | Nava et al. | |
| 6,196,411 | B1 * | 3/2001 | Nava et al. | 220/521 |
| 6,302,288 | B1 | 10/2001 | Nava et al. | |
| 6,311,860 | B1 | 11/2001 | Reidinger et al. | |
| 6,374,726 | B1 * | 4/2002 | Melton | 99/323 |
| 6,688,487 | B2 * | 2/2004 | Oakes et al. | 220/788 |
| 2002/0074337 | A1 | 6/2002 | Melton | |

FOREIGN PATENT DOCUMENTS

EP 1 367 001 A1 12/2003

* cited by examiner

*Primary Examiner*—Lien M. Ngo
(74) *Attorney, Agent, or Firm*—Banner & Whitcoff, Ltd.

(57) ABSTRACT

Drinking cup lids are especially adapted and configured to afford some measure of protection to the game piece from beverage seepage through a straw opening. Preferably, the cup lid is configured so that a game piece is spaced above the straw opening co-located within a recessed well of the lid thereby allowing beverage seepage to remain physically separated from the game piece. Access to the beverage within the cup is facilitated by providing a cross-cut straw aperture in the game piece which is in substantial alignment to the straw opening formed in the lid. A beveled segment of a raised plateau on which the game piece is affixed allows a tab associated with the game piece to be more easily grasped and removed by a customer to reveal the printed text/indicia of the game piece.

32 Claims, 6 Drawing Sheets

DRINKING CUP LIDS WITH PROMOTIONAL GAME PIECE

FIELD OF THE INVENTION

The present invention relates generally to the field of drinking cup lids. More specifically, the present invention relates to drinking cup lids which are especially adapted to be combined with promotional game pieces.

BACKGROUND OF THE INVENTION

It has been increasingly popular for food retailers, especially restaurants in the so-called "fast-food" industry, to offer promotional games to attract customers and increase product sales. Such promotional games are usually based upon the distribution to individual customers of a game piece which includes some form of printed text and/or indicia relating to the particular promotional game being played. The game piece usually has some form of covering material which hides the printed text/indicia until removed physically by the customer, such as a layer of an opaque material which must be scratched off or an opaque removable covering sheet. Upon removal of the covering material, the printed text/indicia pertinent to the promotional game will thereby be revealed.

In order to increase worker efficiencies at the point of food sales, it is especially preferred that promotional game pieces be physically attached to or incorporated integrally as a part of the containers in which the food is served. Thus, promotional game pieces have been physically attached to sandwich wrappers, fried food containers, drinking cups and drinking cup lids, to name a few.

Recently, U.S. Pat. Nos. 6,311,860 and 5,971,195 (the entirety of each patent being expressly incorporated hereinto by reference) have proposed positioning a game piece in a well of a drinking cup lid. Since the lid of the '860 and '195 patents (and for that matter virtually any other commercially viable drinking cup lid) includes a perforated cross-cut opening to facilitate insertion of a drinking straw, it is necessary to protect the printed indicia of the game piece from being obliterated by the contents of the drinking cup which may seep through the straw opening. According to the '860 and '195 patents, such protection is afforded by a liquid-resistant shield member positioned in covering relationship between the straw opening and the game piece. Specifically, a liquid-resistant shield member is placed flush on the floor surface of a recessed well so as to cover the cross-cut straw opening. The game piece may then be positioned between the shield member and a removable sealing member.

While the game piece lid construction of the '860 and '195 patents may safeguard the actual game piece from damage by liquid seepage through the straw opening, the actual placement of the game piece and shield and sealing members is somewhat cumbersome. It would therefore be desirable if a cup lid and game piece could be provided which promote greater ease of manufacture, while at the same time afford some measure of protection to the game piece from beverage seepage through the straw opening. It is towards fulfilling such a need that the present invention is directed.

SUMMARY OF THE INVENTION

Broadly, the present invention is embodied in a cup lid which is especially adapted and configured to promote a greater ease of manufacture, while at the same time afford some measure of protection to the game piece from beverage seepage through the straw opening.

In especially preferred embodiments, the cup lid is configured so that a game piece is spaced above the straw opening thereby allowing beverage seepage to remain physically separated from the game piece. Most preferably, the cup lid is configured to include a raised central plateau having recessed well in which the straw opening is co-located. The game piece may thus be placed on the top planar surface of the plateau in covering relationship to, but spaced physically above, the straw opening. In such a manner, beverage seepage through the straw opening is capable of "puddling" in the recessed well of the cup lid without damaging the game piece. In order to facilitate access to the beverage within the cup upon removal of the game piece, it is especially preferred that the underlying protective liner of the game piece itself be provided with a cross-cut perforated straw aperture which is in substantial alignment to the straw opening formed in the lid.

Preferably, the raised central plateau will also include a beveled segment of its perimeter. Thus, if the raised central plateau is in the form of a substantially circular structure, at least a perimetrical circumferential segment of the plateau will be a beveled structure which is adapted to be positioned subjacent to a pull tab associated with the covering layer which visually obscures the printed text/indicia associated with the affixed game piece. In such a manner, therefore, the tab may be more easily grasped and removed by a customer to reveal the printed text/indicia of the game piece.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

Figure 6:
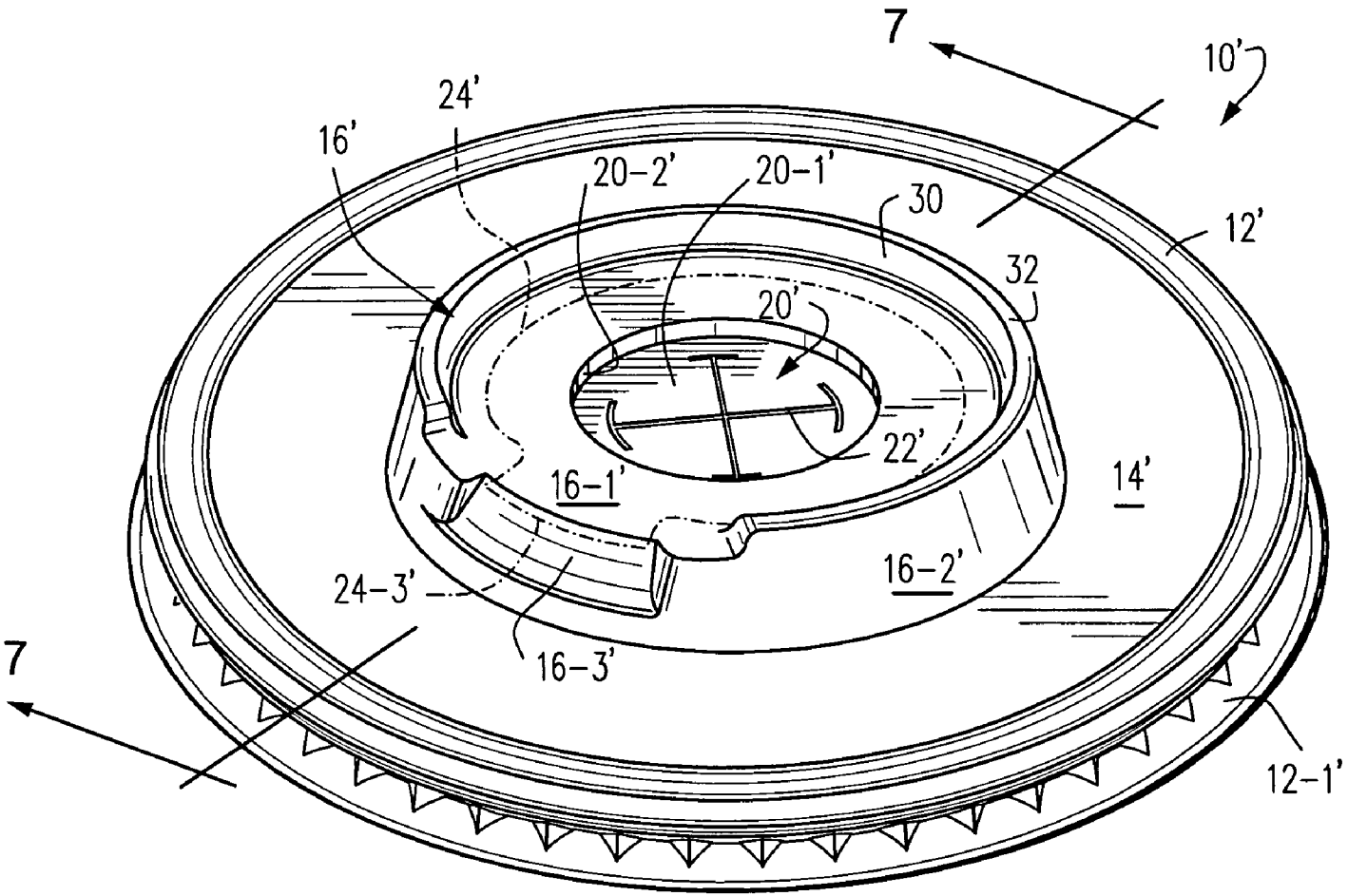
Figure 7:
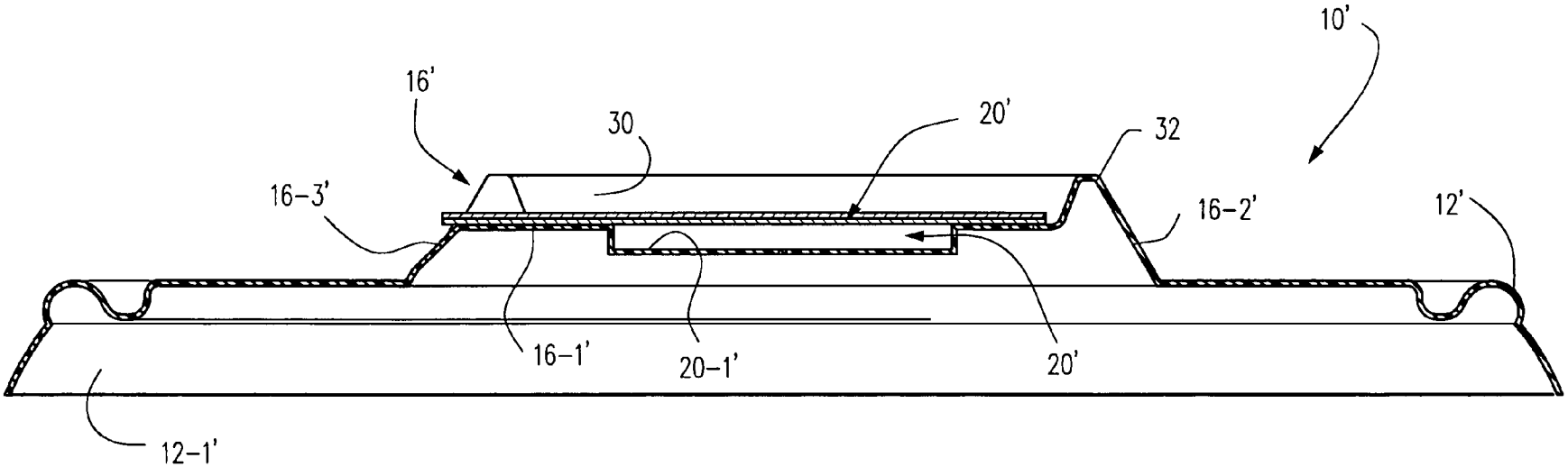

FIG. 6 a top perspective view of another exemplary drinking cup lid in accordance with the present invention that is especially configured and adapted to have a game piece affixed thereto; and FIG. 7 is a cross-sectional elevational view of the lid depicted in FIG. 6, as taken along line 7—7 therein.

DETAILED DESCRIPTION OF THE INVENTION

Figure 1:
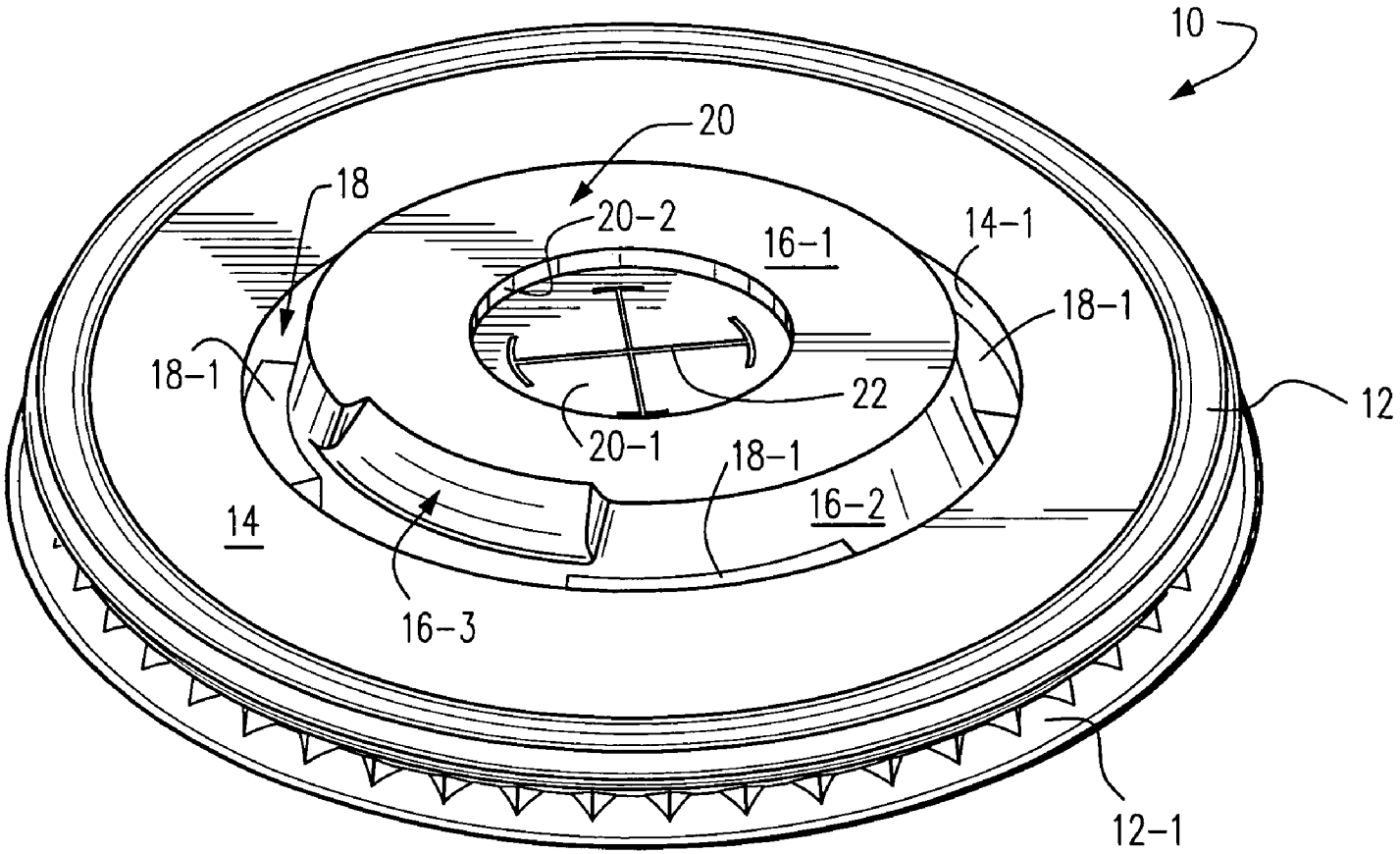
FIG. 1 is a top perspective view of an exemplary drinking cup lid that is especially configured and adapted to have a game piece affixed thereto.

An especially preferred drinking cup lid 10 according to the present invention is depicted in accompanying FIG. 1. The lid 10 is most preferably a one-piece (unitary) structure formed of a suitable thermoformable plastics material. As is conventional, the lid 10 includes a circumferential rim 12 which is adapted to frictionally engage the top lip of a drinking cup (not shown), and a circumferential skirt 12-1 depending therefrom which facilitates engagement/disengagement between the rim 12 and the drinking cup's top lip. An annular top lid wall 14 is joined at its outer peripheral edge to the rim 12, and includes an inner, preferably cylindrically shaped, annular wall 14-1 depending therefrom.

Important to the present invention, a substantially centrally located plateau 16 is provided and includes a horizontally planar annular upper wall 16-1 and a generally conically shaped circumferential side wall 16-2. The upper wall 16-1 is elevated to a height so as to be physically above the annular top lid wall 14. As such, the plateau 16 protrudes physically upwardly from the lid 10. As is perhaps best shown in accompanying FIGS. 3 and 4, the side wall 16-2 is joined to the annular top lid wall 14 via an annular horizontal bottom wall 14-2 thereby forming a recessed annular trough 18 in surrounding relationship to the raised plateau 16. The plateau 16 is also provided with a circumferential beveled wall segment 16-3, the purpose of which will be explained in greater detail below.

A circumferential series of annular raised segments 18-1 are positioned within the trough 18 so as to facilitate stacking of the lids 10. Specifically, when stacked, the bottom walls 14-2 will contact the raised segments 18-1 so as to impart stackability to the lids. As such, the rims 12 of stacked lids 10 will be precluded from frictionally engaging one another thereby ensuring ease of lid separation from the stack.

A recessed well 20 is provided in a central location within the top plateau wall 16-1 and includes a planar bottom wall 20-1 and a substantially cylindrically shaped side wall 20-2. The dimension of the side wall 20-2 of course determines the extent to which the bottom wall 20-1 is recessed relative to the plateau top wall 16-1 (and hence determines the "depth" of the recessed well 20). Most preferably, the side wall 20-2 of the well 20 is dimensioned so as to place the bottom wall 20-1 at a location horizontally between the upper plateau wall 16-1 and annular top lid wall 14. A drinking straw may be inserted through a conventional cross-cut opening 22 formed in the bottom wall 20-1.

Figure 2:
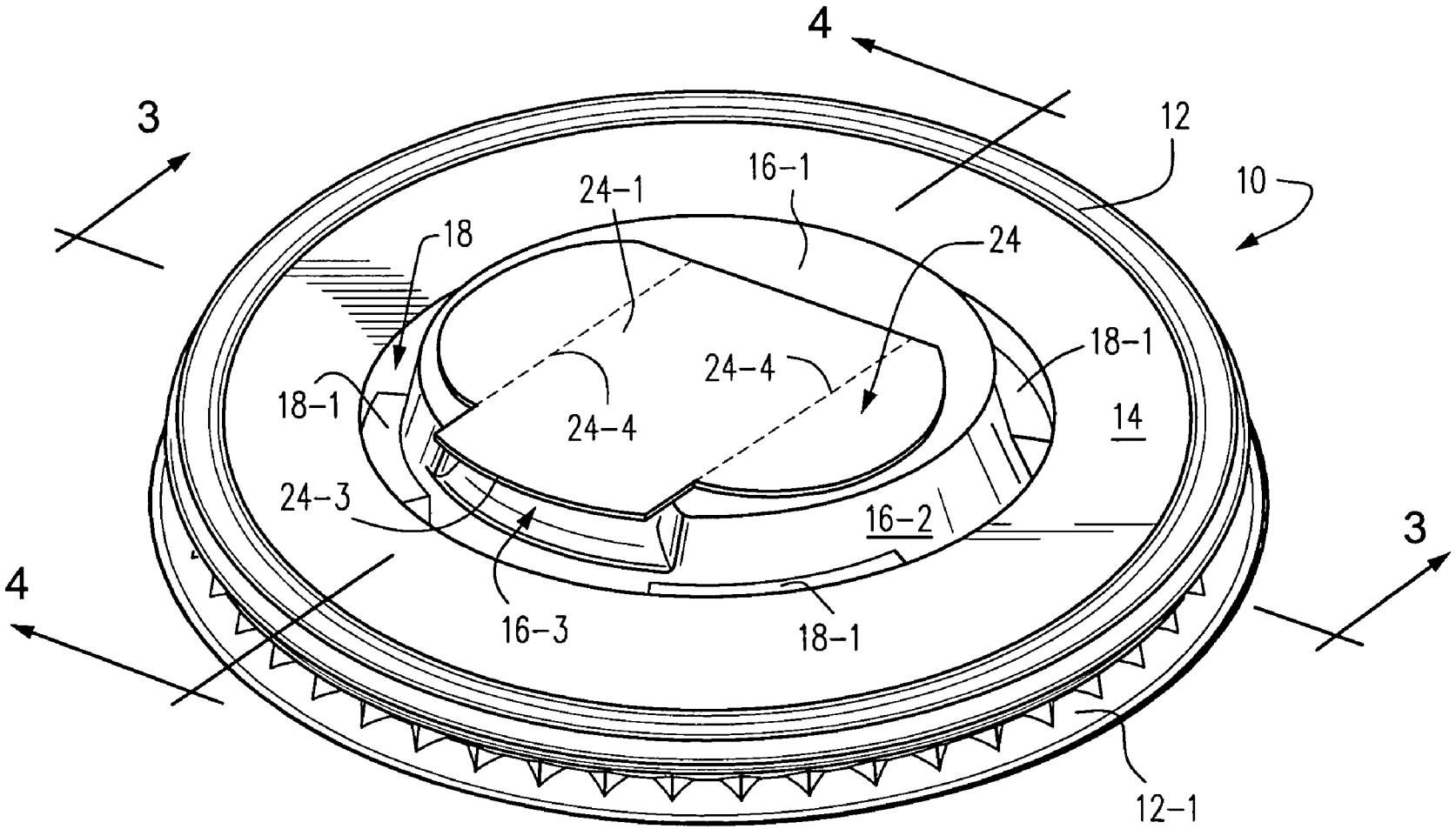
FIG. 2 is a top perspective view of the cup lid depicted in FIG. 1, but also showing one possible form of a game piece affixed thereto.
Figure 3:
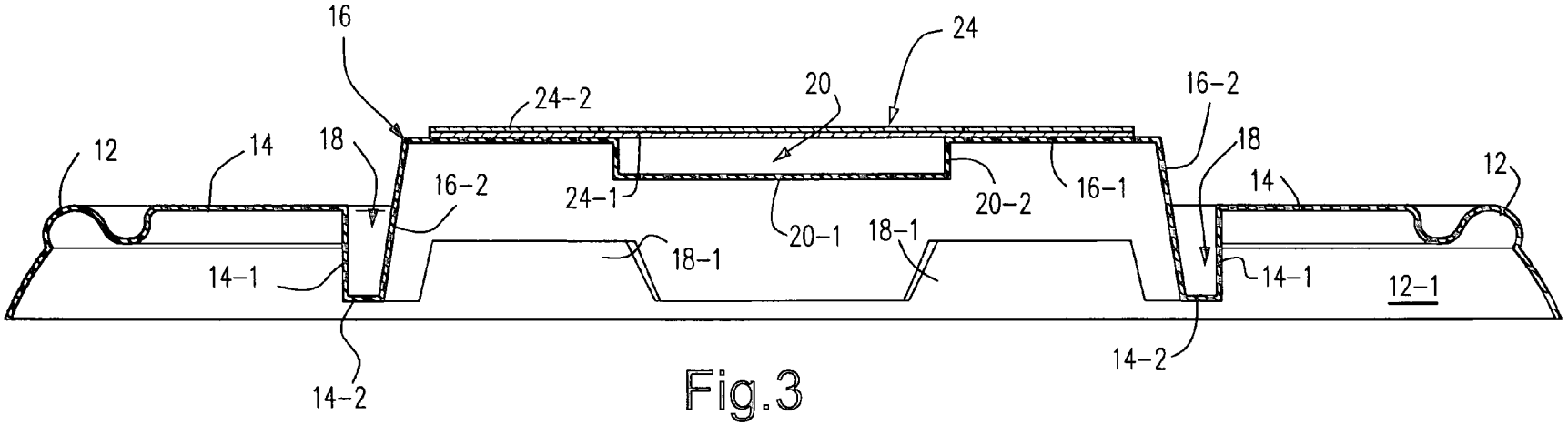
FIG. 3 is a cross-sectional elevational view of the lid depicted in FIG. 2 as taken along lines 3—3 therein.
Figure 4:
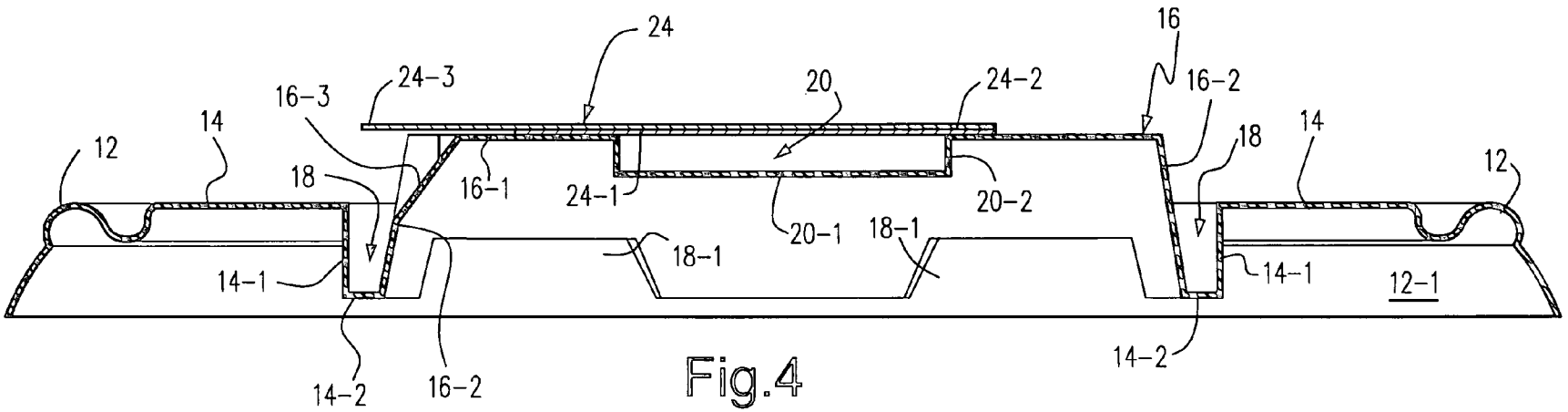
FIG. 4 is another cross-sectional elevational view of the lid depicted in FIG. 2 as taken along lines 4—4 therein.

Accompanying FIGS. 2–4 depict the drinking cup lid 10 described above with reference to FIG. 1, in addition to a game piece 24 affixed thereto. As is depicted, the game piece 24 essentially includes a lower sheet layer 24-1 and an upper sheet layer 24-2 which covers the lower sheet layer. The upper sheet layer 24-2 is most preferably opaque so as to visually hide the game informative text/indicia GI (see FIG. 5) which may be printed or affixed on its lower surface immediately adjacent the lower sheet layer 24-1. Alternatively, the game informative text/indicia GI could be printed on the upper surface of the lower sheet layer 24-1 if desired. The upper sheet layer 24-2 also includes a tab portion 24-3 which extends outwardly from the plateau 16 over the beveled segment 16-3 thereof.

As shown in FIGS. 3 and 4, the game piece 24 is positioned and affixed to the top plateau wall 16-1 so that the lower sheet layer 24-1 covers the recessed well 20. As such, the lower sheet layer 24-1 is physically spaced above the bottom wall 20-1 of the well 20. In such a manner, therefore, any seepage that may occur through the cross-cut straw opening 22 is allowed to puddle within the well 20 without damaging the game-informative text/indicia GI printed on or affixed to the lower surface of the game piece sheet layer 24-2.

Most preferably, a cross-cut aperture 26 is formed through the lower sheet layer 24-1 of the game piece 24 and is oriented in substantial positional alignment relative to the straw opening 22 formed in the bottom wall 20-1 of the recessed well 20. In such a manner, therefore, once the game piece portion of the upper sheet layer 24-2 has been removed, access to the cup contents may be achieved by placement of a drinking straw through both the straw opening 22 of the well 20 and the straw aperture 26 of the game piece 24.

Figure 5:
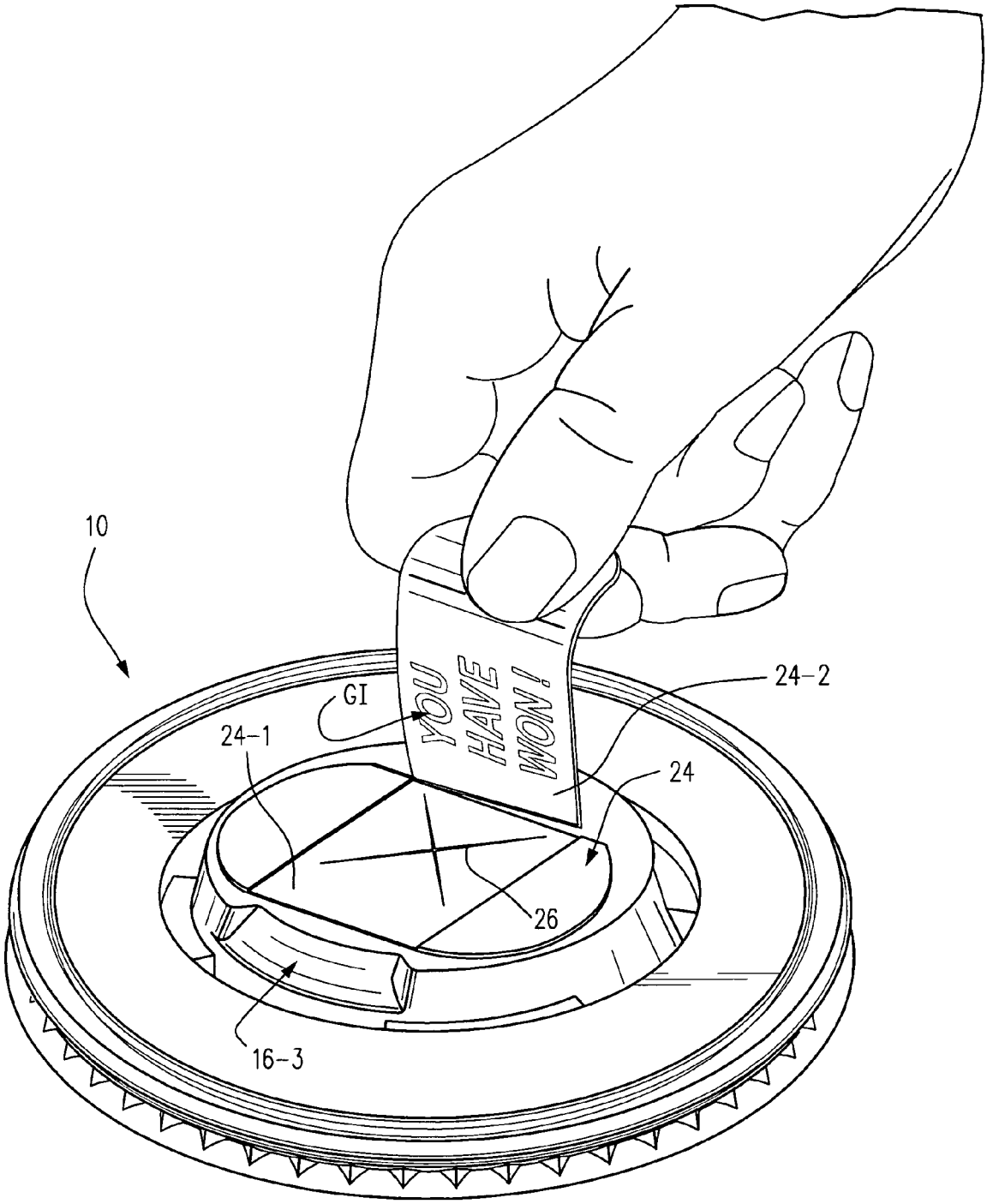
FIG. 5 is a top perspective view of the cup lid depicted in FIG. 2, showing the manner in which the covering layer may be removed physically from the game piece to reveal the printed text/indicia thereof.

Accompanying FIG. 5 depicts schematically the use by a customer of the combined lid 10 and game piece 24 in accordance with the present invention. As shown, the customer may physically grasp the outwardly extending tab portion 24-3 and thereby manually peel a central section of the upper sheet layer 24-2 away from the lower sheet layer 24-1 (which remains affixed to the plateau wall 16-1) due to the presence of perforations 24-4 in the upper layer 24-2, thereby revealing the game-informative text/indicia GI.

Another exemplary container lid 10' in accordance with the present invention is depicted in accompanying FIGS. 6 and 7. In this regard, structures similar to the lid 10 discussed previously bear the same reference numeral in the lid 10' depicted in accompanying FIGS. 6 and 7, but are differentiated by a prime (') designator. A detailed discussion of such similar structures will thus not necessarily be repeated. Attention is therefore directed to the discussion thereof which appears previously with regard to the embodiment of lid 10.

It will especially be observed in FIGS. 6 and 7, that the plateau 16' includes a generally conically shaped circumerential side wall 16-2' attached unitarily at its bottom to the planar annular top lid wall 14'. The upper end of the outer side wall 16-2' is joined to an inner side wall 30. The upper end of the side wall 16-2' and the inner side wall 30 thereby collectively establish a raised ridge 32 which is concentric with the recessed well 20'. In addition, the ridge 32 circumferentially bounds the recessed well 20' from locations generally adjacent each lateral side of the beveled wall segment 16-3' formed in the plateau 16'. The ridge 32 is thus in the form of a circumferential wall segment which extends upwardly from and partially surrounds the annular upper wall 16-1' of the plateau 16'.

In the embodiment of FIGS. 6 and 7, the plateau upper wall 16-1' is thus spaced above the annular lid wall 14' so as to allow sufficient space below the tab 24-3' of the game piece 24' and thereby allow a user to grasp the same. The beveled segment 16-3' also ensures that some space will be present below the tab 24-3' to facilitate grasping thereof. Moreover, the raised ridge 32 allows the game piece 24' to be easily positionally seated within the plateau 16' during manufacture.

As should now be quite apparent, the present invention cup lids are provided in accordance with the present invention which are especially adapted and configured to allow a customer to access the beverage in the cup without necessarily having to first remove the game piece, while at the same time afford some measure of protection to the game piece from beverage seepage through the straw opening.

However, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A drinking cup lid comprising a raised central plateau adapted to receive a promotional game piece, said central plateau having an outer sidewall, a planar annular upper wall, and a recessed wall located in said annular upper wall, the outer sidewall including a circumferential beveled segment extending along a portion of the outer sidewall over which a tab of the game piece may extend to thereby facilitate grasping of the game piece tab by a customer, the circumferential beveled segment angled with respect to the outer sidewall, the lid further comprising an annular trough surrounding said central plateau and a circumferentially spaced apart series of annular raised segments positioned within said trough.

2. The lid of claim 1, further comprising a straw opening co-located with said recessed well.

3. The lid of claim 2, wherein the straw opening is in the form of a cross-cut opening.

4. The lid of claim 1, further comprising an annular lid top wall surrounding the annular trough.

5. The lid of claim 1, comprising a circumferential rim for frictional engagement with a cup lid.

6. The lid of claim 1, wherein the plateau includes a ridge which extends upwardly from, and partially circumferentially bounds, said planar annular upper wall.

7. The lid of claim 6, further comprising a straw opening co-located within said recessed well.

8. The lid of claim 7, wherein the straw opening is in the form of a cross-cut opening.

9. The combination comprising a lid as in any one of claims 1, 2, 2 and 4–7, and a promotional game piece affixed to said central plateau.

10. The combination as in claim 9, wherein the game piece includes a straw aperture in substantial alignment with said straw opening co-located within said recessed well.

11. A drinking cup lid comprising:

an annular circumferential rim adapted to being physically attached to a top lip of a drinking cup;

a raised central plateau;

a recessed well formed in said plateau, the recessed well having a bottom wall, wherein the plateau includes a raised annular upper wall which surrounds said recessed well and a ridge which extends upwardly from, and partially circumferentially bounds, said planar annular upper wall; and a promotional game piece affixed to said lid so as to cover said recessed well in spaced relationship to said bottom wall thereof.

12. The lid of claim 11, wherein said raised plateau further comprises a straw opening co-located within said recessed well, and wherein said game piece further comprises a straw aperture in substantial alignment with said straw opening.

13. the lid of claim 12, wherein at least said straw opening is in the form of a cross-cut opening.

14. The lid of claim 12, wherein each of said straw opening and said straw aperture is in the form of a cross-cut opening.

15. The lid of claim 11, further comprising an annular trough surrounding said central plateau.

16. The lid of claim 15, further comprising a circumferentially spaced apart series of annular raised segments positioned within said trough.

17. The lid of claim 15, further comprising an annular lid top wall surrounding the annular trough.

18. The lid of any one of claims 11 and 12–17, wherein the raised plateau includes a circumferential beveled segment, and wherein the game piece includes a tab which extends outwardly over the beveled segment of the raised plateau, wherein grasping of the game piece tab by a customer is facilitated.

19. The lid of claim 11, wherein the game piece includes a lower sheet layer, and upper removable covering layer containing game text and/or indicia.

20. The lid of claim 19, the raised plateau includes a circumferential beveled segment, and wherein the upper sheet layer of the game piece includes a tab which extends outwardly over the beveled segment of the raised plateau, wherein grasping of the tab by a customer and removal of at least a portion of the upper sheet layer is facilitated.

21. The lid of claim 11, further comprising a straw opening co-located within said recessed well.

22. The lid of claim 21, wherein the straw opening is in the form of a cross-cut opening.

23. A method of making a drinking cup lid comprising:

(a) providing a drinking cup lid with a raised central plateau which includes a planar annular upper wall, a circumferential beveled segment, a recessed well having a bottom surface located in said annular upper wall, and an upwardly extending ridge which partially circumferentially bounds said recessed well between lateral end locations of the circumferential beveled segment, and (b) affixing a promotional game piece to said annular upper wall such that said game piece covers said recessed well in spaced relationship to said bottom surface thereof.

24. The method of claim 23, further comprising a straw opening co-located within said recessed well.

25. The method of claim 24, wherein said step of providing the straw opening includes forming a cross-cut in the recessed well.

26. The method of claim 23, further comprising providing an annular trough surrounding said central plateau.

27. The lid of claim 23, wherein said game piece includes a tab, and wherein step (b) is practiced by affixing the game piece to said annular upper wall such that said tab extends outwardly over said beveled circumferential segment.

28. The lid of claim 23, wherein said game piece includes a tab, and wherein step (b) is practiced by affixing the game piece to said annular upper wall such that said game piece is positioned within the bounds of said ridge, and such that said tab extends outwardly over said beveled circumferential segment.

29. A drinking cup lid comprising:

a substantially circular raised plateau comprising a top surface and a substantially cylindrical outer side wall depending from the top surface, the outer side wall having an indented portion, and the top surface having an indented portion corresponding to the indented portion of the side wall; and a game piece affixed to the top surface of the plateau, the game piece comprising a tab, a portion of the tab extending over the indented portion of the side wall to facilitate grasping of the tab by a user.

30. A drinking cup lid assembly comprising:

a lid comprising an annular rim, adapted to be attached to a top lip of a drinking cup, and a raised plateau having a top surface and an outer side wall depending from the top surface, the outer side wall having a beveled segment extending along a portion of the outer sidewall, wherein the beveled segment is angled with respect to the outer sidewall, and the top surface of the raised plateau having a recessed well having a bottom wall; and a promotional game piece affixed to the top surface of the plateau around a periphery of the recessed well in spaced relationship to the bottom wall thereof, the game piece comprising a tab, a portion of the tab extending over the beveled segment of the side wall to facilitate grasping of the tab by a user.

31. A drinking cup lid comprising:

an annular circumferential rim adapted to being physically attached to a top lip of a drinking cup;

a raised central plateau;

a recessed well formed in said plateau, the recessed well having a bottom wall; and a promotional game piece affixed to said lid so as to cover said recessed well in spaced relationship to said bottom wall thereof, the game piece including a lower sheet layer and an upper removable covering layer containing game text and/or indicia.

32. The lid of claim 31, wherein the raised plateau includes a circumferential beveled segment, and wherein the upper sheet layer of the game piece includes a tab which extends outwardly over the beveled segment of the raised plateau, wherein grasping of the tab by a customer and removal of at least a portion of the upper sheet layer is facilitated.

* * * * *